US005413083A

United States Patent [19]

Jones

[11] Patent Number: 5,413,083

[45] Date of Patent: May 9, 1995

[54] ATTACHMENT FOR A PAINT PELLET GUN

[76] Inventor: Barry P. Jones, 5908 Lundy Dr., Lanham, Md. 20706

[21] Appl. No.: 144,562

[22] Filed: Nov. 2, 1993

[51] Int. Cl.[6] ..... F41B 11/00

[52] U.S. Cl. ..... 124/32; 124/56; 124/72

[58] Field of Search ..... 124/1, 31, 32, 56, 70–74, 124/76, 77, 80

[56] References Cited

U.S. PATENT DOCUMENTS

| | | | |
|---|---|---|---|
| 1,167,178 | 1/1916 | Hill | 124/77 X |
| 2,568,432 | 9/1951 | Cook | 124/77 X |
| 3,494,344 | 2/1970 | Vadas et al. | 124/74 |
| 3,899,845 | 8/1975 | Wild et al. | 124/32 X |
| 4,694,815 | 9/1987 | Hung | 124/32 X |
| 4,899,717 | 2/1990 | Rutten et al. | 124/32 X |
| 5,261,384 | 11/1993 | Hu | 124/32 X |

*Primary Examiner*—Randolph A. Reese
*Assistant Examiner*—John A. Ricci
*Attorney, Agent, or Firm*—David Lewis

[57] ABSTRACT

An attachment to a paint ball gun which adapts the gun to fire in automatic, semiautomatic, or in essentially any desired pattern of fire. The gun attachment has a mechanical mechanism for manipulating a protrusion on the gun, such as a bolt handle, a programmable pulse generator for determining the pattern of fire, and an electromechanical device for converting the signals generated by the pulse generator into a mechanical motion for driving the mechanical mechanism which manipulates the bolt handle or protrusion.

16 Claims, 13 Drawing Sheets

PRIOR ART

ATTACHMENT FOR A PAINT PELLET GUN

BACKGROUND OF THE INVENTION

There are a host of paint pellet guns available on the market. Some of these have semiautomatic fire such as the PRO/AM (trade name) by Tippmann Pneumatics, Inc. (located at 3518 Adams Center Road, Fort Wayne, Ind. 46806, phone number 219-749-6022). One problem with these guns is that when they are low on carbon dioxide the bolt does not have enough momentum when recoiling to latch. Therefore it fires again and again and continues to fire uncontrollably. (This is commonly referred to as cycling.)

One example of a fully automatic paint pellet gun is the Tippmann SMG-60 or the Tippmann SMG-68. The problem with these guns is that they fire too fast. Firing too fast is painful to the victim who gets hit with a multitude of paint pellets rather than just one or two. Firing too fast also wastes ammunition and cools down the gun, causing slower gas expansion, which causes a low pellet velocity. Lower velocity means shorter effective gun range and accuracy. Also a slower moving paint pellet will bounce off an opponent rather than breaking and marking the opponent. The cooled gun also may not give enough velocity to the recoiling bolt for the bolt to latch, causing repeated uncontrolled firing of the gun (cycling) even when the trigger is released.

Finally, the method of delivering a pellet to the firing chamber during full auto firing necessitates spring-fed clips to ensure quick, exact placement of the pellets. This spring-fed clip arrangement restricts the amount of pellets you could carry loaded in the gun to about 20 pellets, and causes the gun operator to have to pre-load hundreds of pellets into clips during the course of the day. Because of the aforementioned problems associated with full auto guns, they gradually fell out of favor and are no longer manufactured. The most popular type of fast shooting gun is now a semi auto. Because of the slower rate of fire with a semi auto, the pellet delivery system is much simpler than full auto. The pellets are simply poured into a hopper, which is set above the gun, and gravity supplies a new pellet to the firing chamber after every shot. The hopper typically holds from 60 to 200 pellets and is easily reloaded by pouring in more pellets as needed. Guns and attachments have now been designed to help this gravity feed by using gas expansion to push the new pellet into the chamber quicker than gravity alone. These feeding improvements still are not fast enough or exacting enough to reliably keep up with a typical full auto rate of fire. Attempting to shoot a semi at extremely fast rates will cause the gun to fire before the pellet has completely entered the firing chamber, causing the pellet to split and burst inside the gun. Additionally, the slight jerking of a semi auto gun while rapidly pulling the trigger causes a distinct loss of aiming accuracy.

FIG. 1 shows an example of one of the prior art guns to which a version of the present invention is attached. This gun has a bolt handle 1 and a trigger 35. The details of the manner in which this gun functions are assumed to be old and well known. Therefore they will not be discussed here. Note, however, that some of these guns use gases other than carbon dioxide such as air or nitrogen.

SUMMARY OF THE INVENTION

The present invention provides a solution for allowing most semi auto paint guns to achieve full auto capabilities while still using the high capacity hopper feeding system of a semi auto. The solution is to slow the gun's rate of fire to a rate the feeding arrangement can keep up with. The present invention also provides a solution to gun cooling by slowing down the rate of fire. The inventor of the invention described herein felt that an electronically controlled rate of fire would be the easiest way to tailor a rate of fire to the needs of the many styles of guns, feeders, and operators. In playing areas where unbridled full auto is not allowed, a dual burst or tri-burst or even a slower, friendlier rate of full auto would be both possible and acceptable. In order to make this type of invention useable by the largest number of guns, it was designed to control the side bolt handle of a semi auto, as nearly every semi auto on the market has a side bolt handle.

The present invention is an attachment to a paint pellet gun having some sort of protrusion, such as a bolt handle, that can be controlled to fire the gun. The attachment allows the gun to be operated as an automatic or semiautomatic gun. Also, the speed of the fully automatic operation is adjustable so as to minimize wasting ammunition and to reduce the number of times a victim is hit during a full auto burst. A side benefit of the electronic control is that the attachment can also be set to fire any pattern of bursts the user desires, such as to shoot two or three shots with each squeeze of the trigger or more complicated patterns. The advantage of choosing the pattern the gun fires is that the pattern can be used to send a message like "help" or "retreat." The pattern can also be used as a method of identifying which players are on the same team, while in thick foliage, for instance. Note: the sound of the gun fire travels farther and is easier to hear than the human voice.

BRIEF DESCRIPTION OF THE DRAWINGS

FIG. 3A shows this view with all components completely assembled.

FIG. 3B is a cross section of the same embodiment as FIG. 3A taken along line 3—3.

FIG. 3C shows all of the components visible in this cross section taken apart.

FIGS. 5A–C are the first embodiment in different positions.

FIG. 5D is another embodiment, which is preferred over the embodiment of FIGS. 5A–C.

Figure 1:
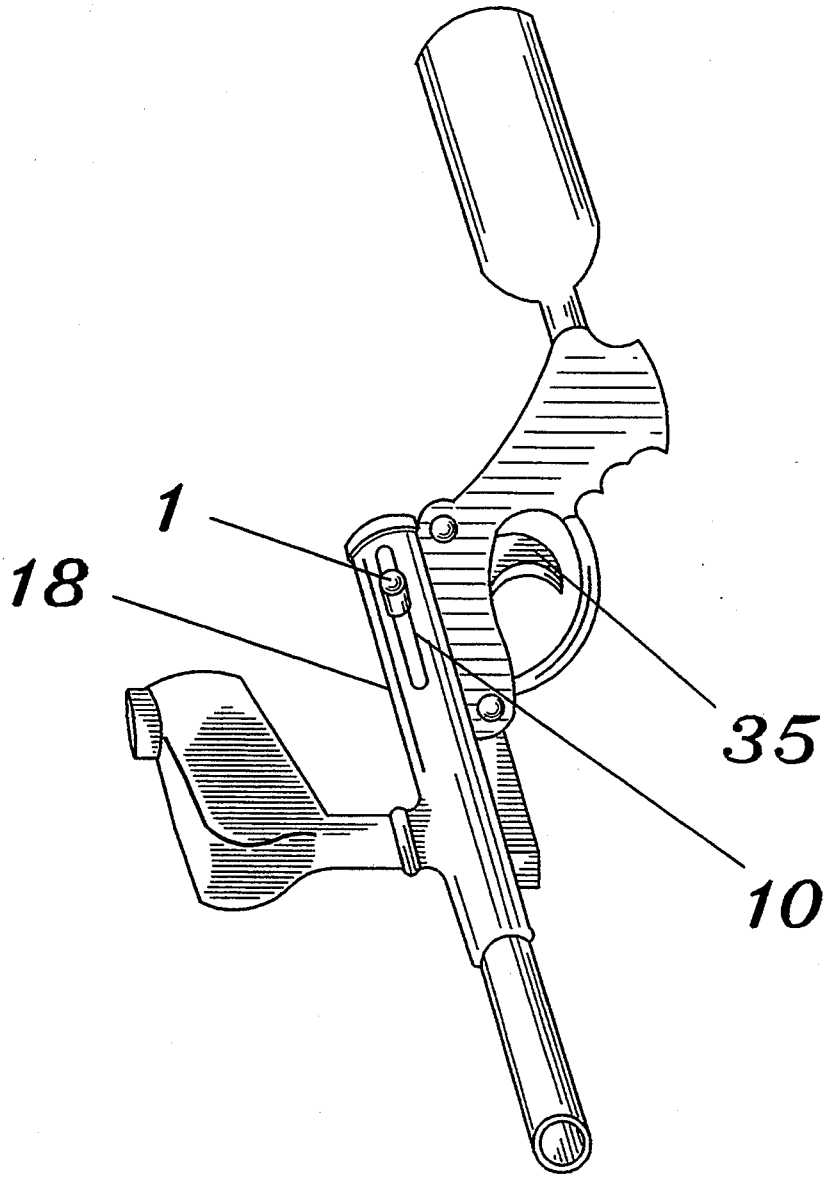
FIG. 1 illustrates a prior art gun for shooting paint pelleting to which the present invention is attached.

Note: In the interest of visual continuity all of the abovementioned drawings are meant to be viewed while holding the drawing pages in the landscape position, with the page title on the right hand side.

DETAILED DESCRIPTION OF THE INVENTION

In order to attach the present invention to a gun, the gun must have some sort of protrusion emanating from the side of it's gun bolt that moves in unison with the gun bolt when the gun is firing. In the PRO/AM (as on many guns), this protrusion is the bolt handle. Before attaching the present invention, any holding connection between the movement of the gun bolt and the trigger, must be disabled. In the PRO/AM the sear pin should be removed, for example. Also, it may be desirable to replace the protrusion with a longer and stronger protrusion. In the PRO/AM, the bolt handle is replaced with one having a longer and stronger bolt handle, for example. Of course, the protrusion need not actually be a bolt handle; it only needs to have an analogous function as the bolt handle on the PRO/AM, for example.

Figure 2:
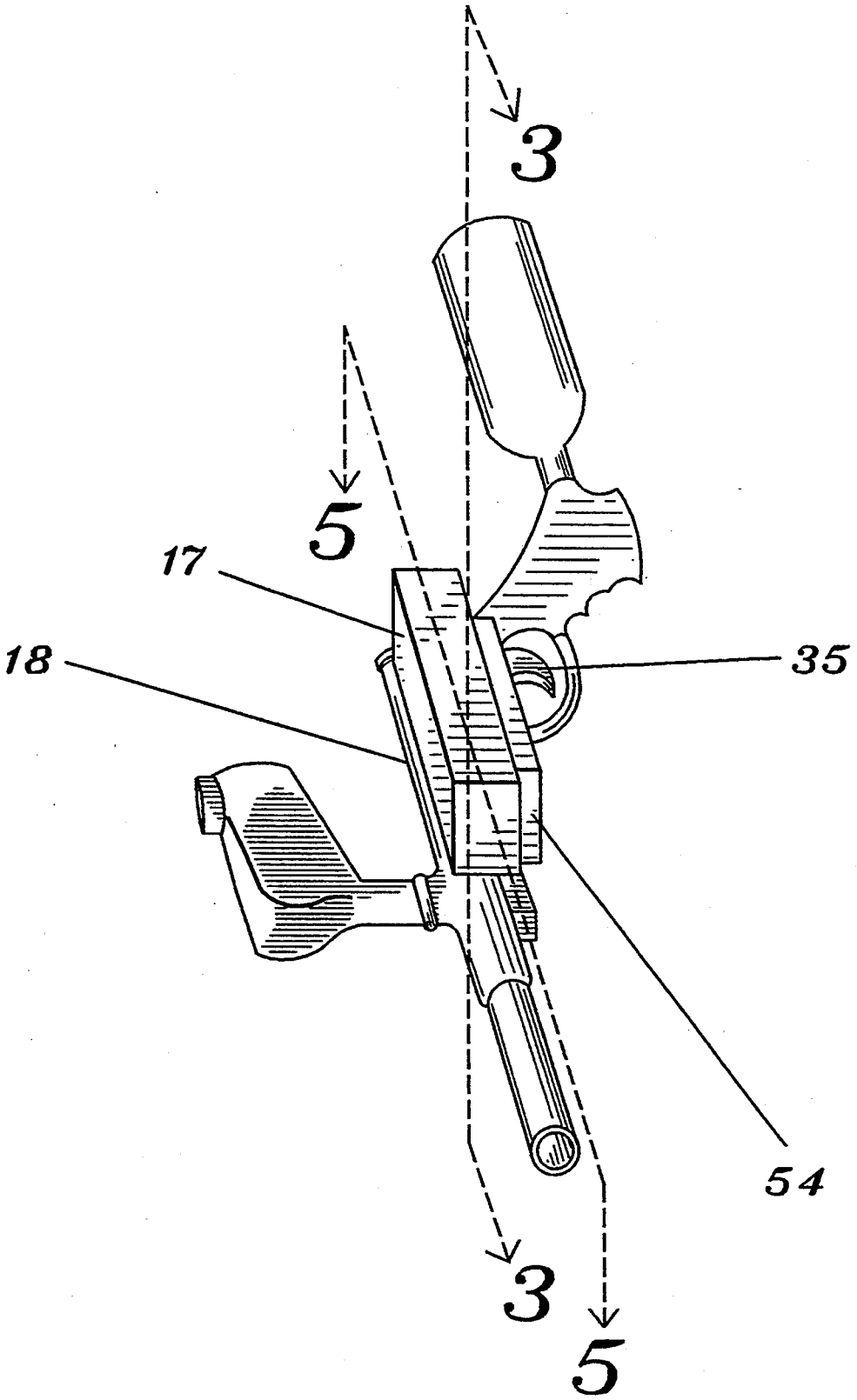
FIG. 2 illustrates the manner in which the present invention is attached to the prior art gun.

FIG. 2 shows the present invention attached to a prior art gun 18. The trigger housing 54 contains the coupling between the trigger 35 and the present invention. The invention is inside the invention housing 17.

Figure 3A:
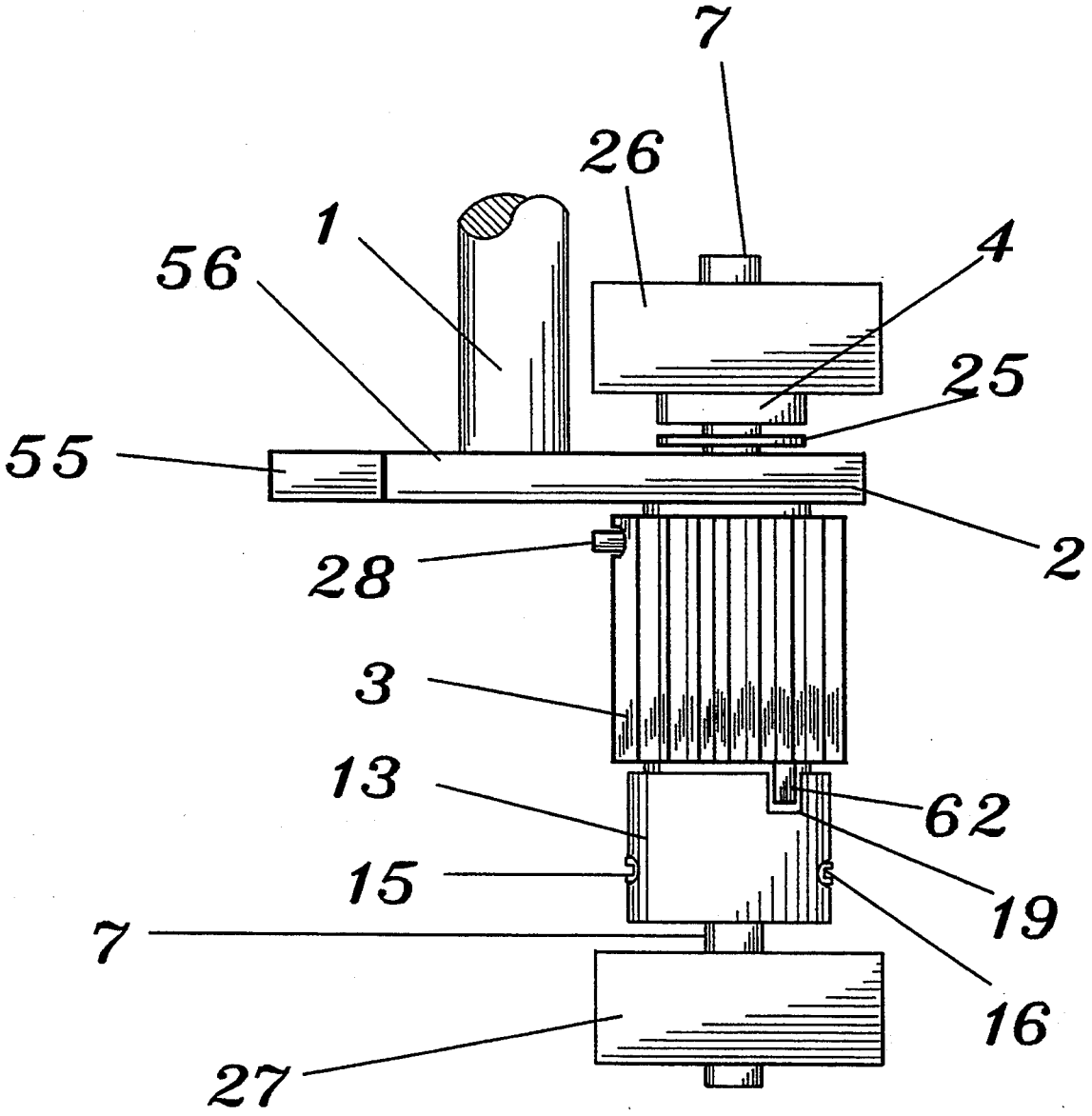
FIGS. 3A–C are schematic illustrations of one embodiment of the present invention when viewed with the housing cut open along line 3—3 of FIG. 2.
Figure 3B:
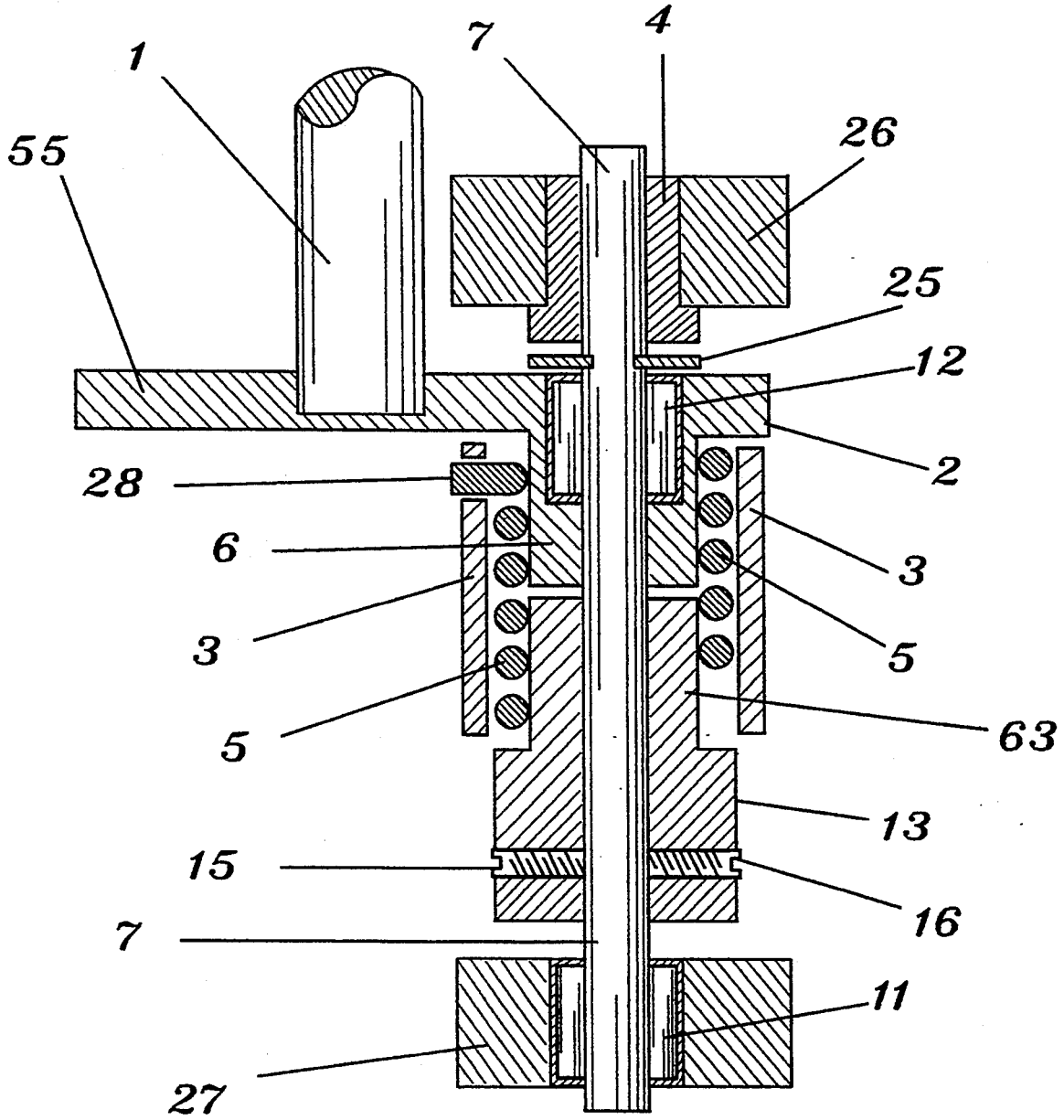
Figure 3C:
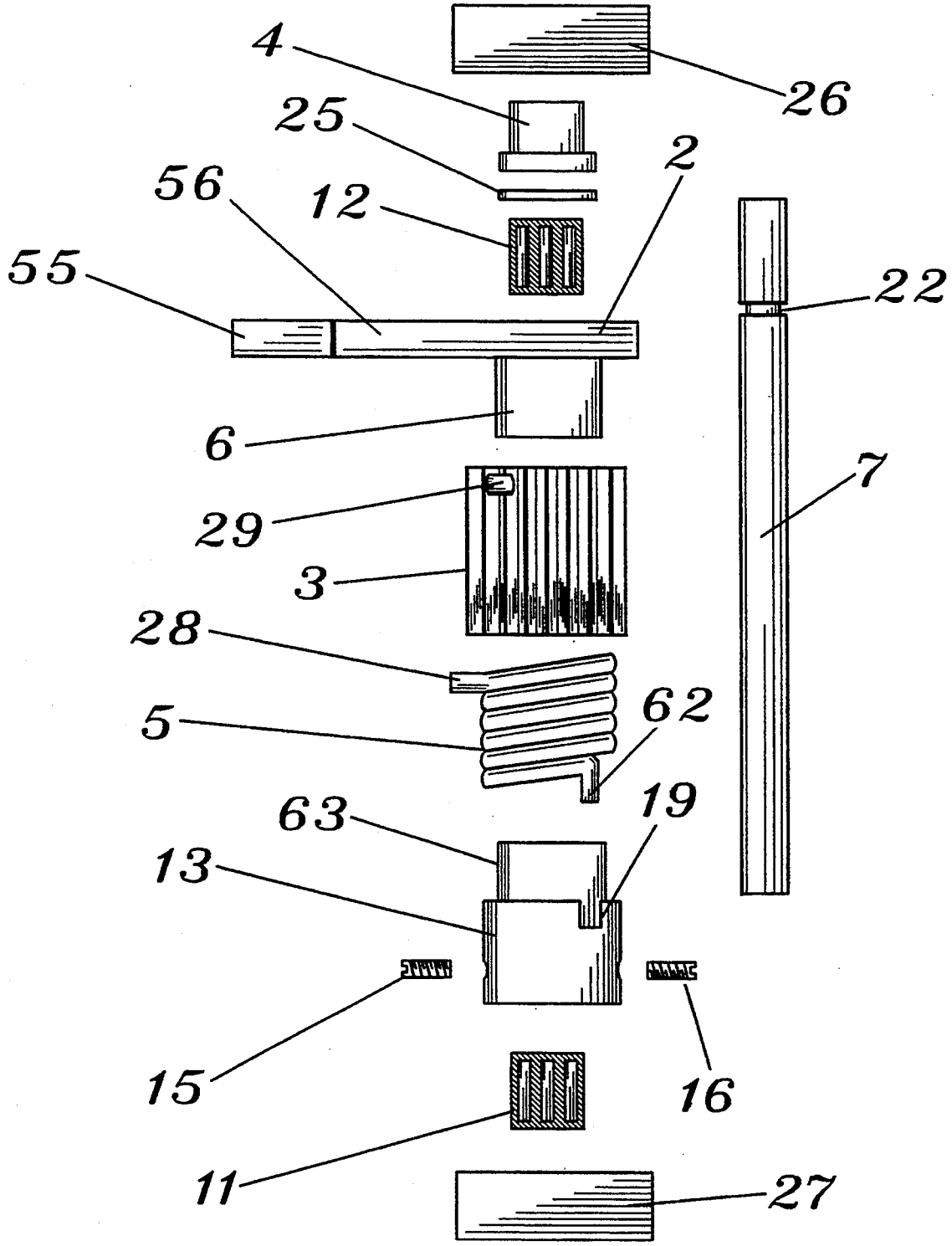
Figure 5A:
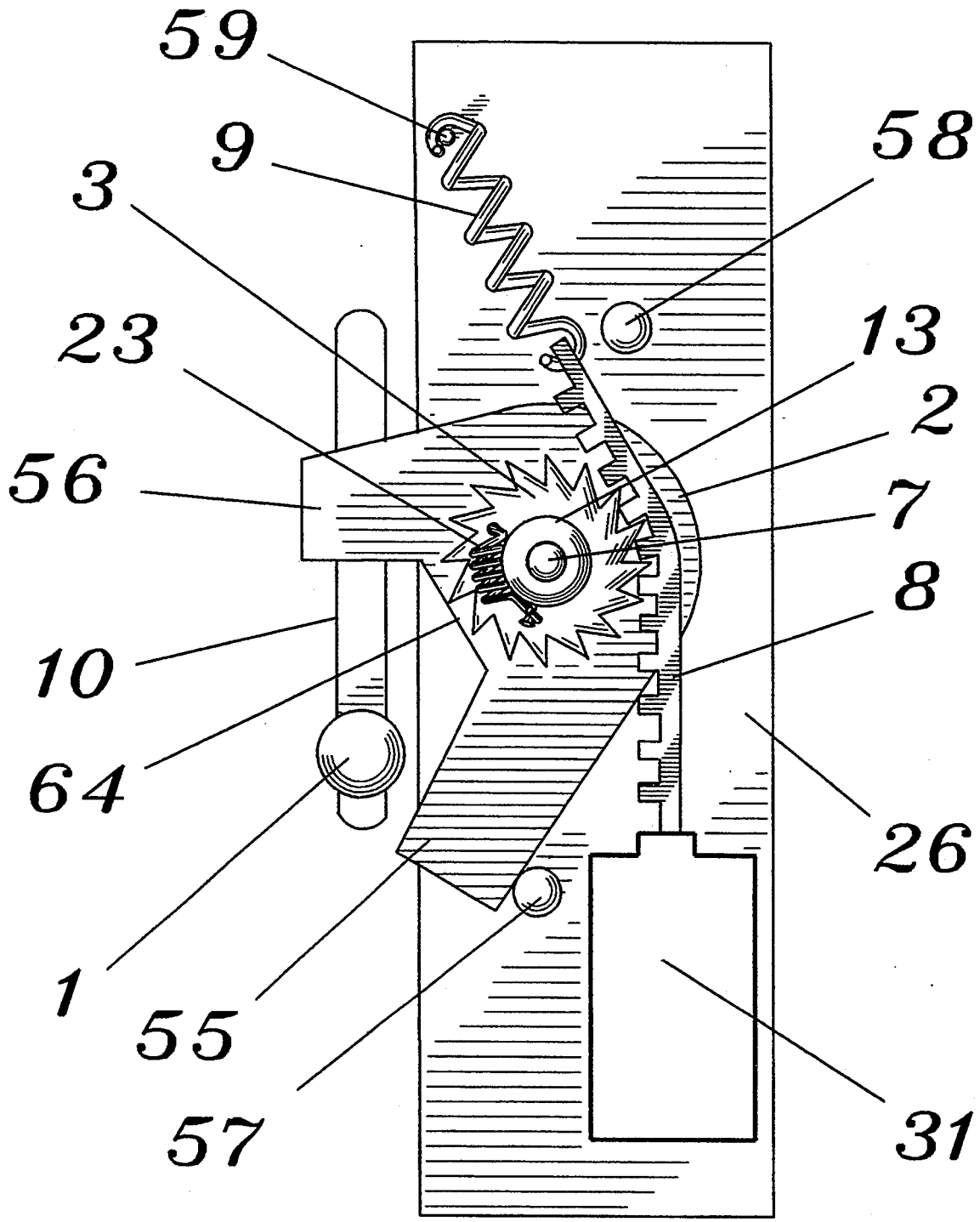
FIGS. 5A–D are schematic illustrations of a cross section two different embodiments of the invention taken along line 5—5.
Figure 5B:
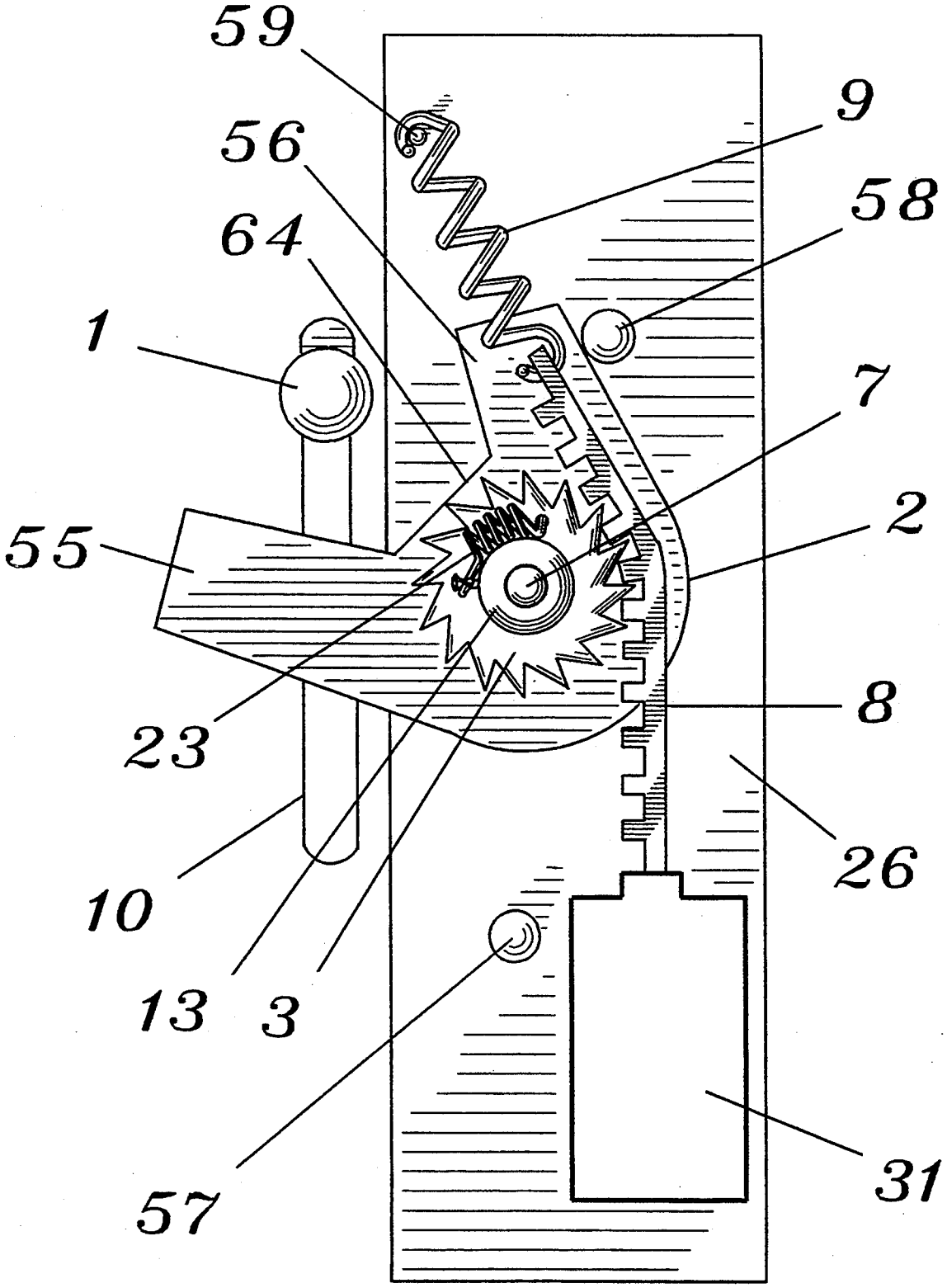
Figure 5C:
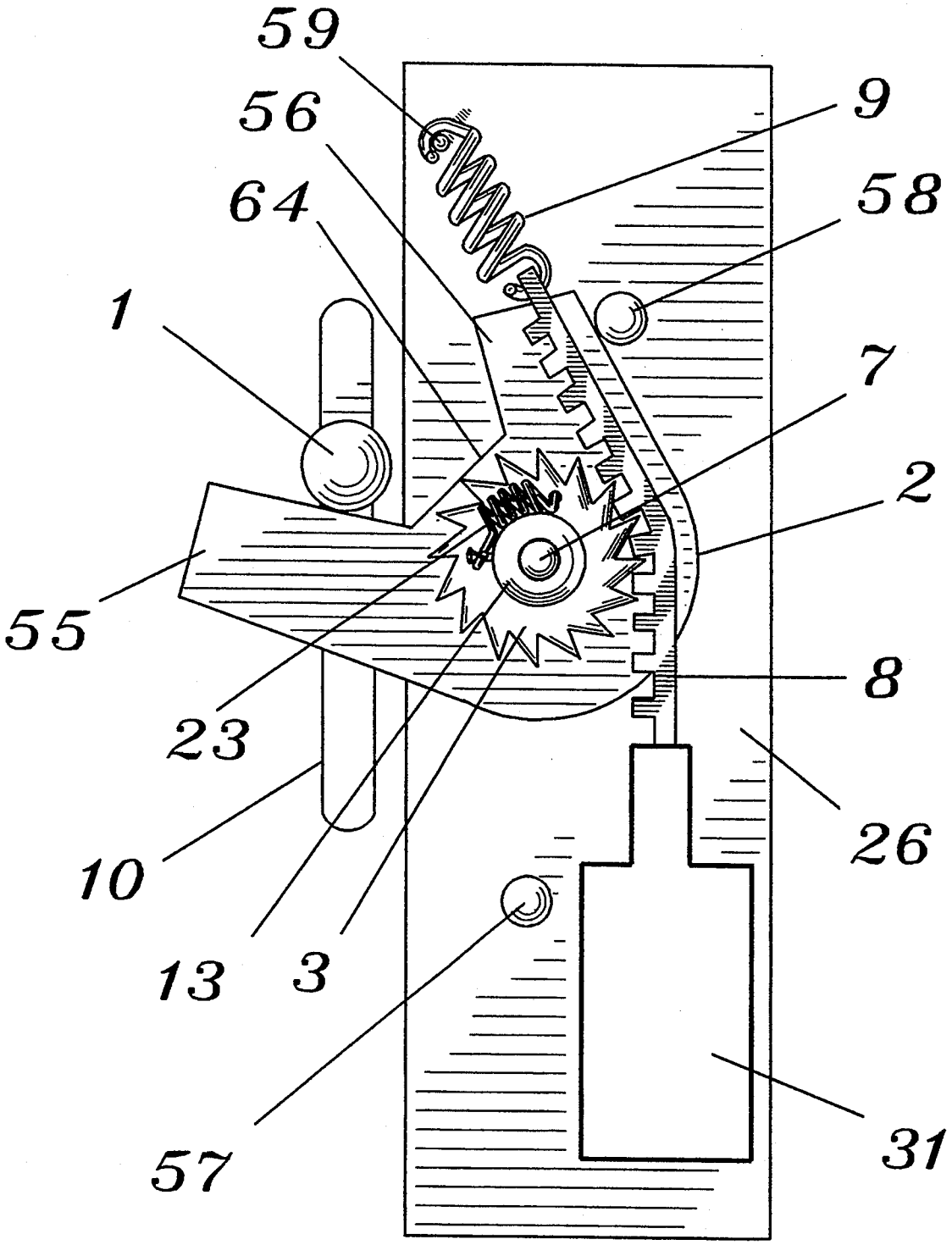

For easier understanding of the workings of this invention, all descriptions of movement or rotation in this entire text are done from perspective 5—5 (as in FIGS. 5A–D). FIGS. 3A–C show the mechanical parts of one embodiment of the present invention. The one way needle bearing 11 is attached to the front frame 27 and is a means of allowing axle 7 to rotate in only one direction. In the preferred embodiments, the axle 7 can only rotate clockwise. The boss, having boss body 13 and boss shaft 63, is held onto the axle 7 via screws 15 and 16 such that it rotates with the axle 7, thereby becoming one with the axle 7. The bolt catch body 2 is a means for catching and engaging the gun bolt handle 1. As illustrated in FIGS. 3A–C and 5A–D, the bolt catch has two portions. One portion, which will be called the bolt catch body 2, has a front finger 55, back finger 56, and a pocket 64 which form a notch for engaging the bolt handle 1. The other portion 6 is a shaft to be called the bolt catch shaft. The bolt catch could be either one piece of metal or else two pieces of metal attached which act as one piece and rotate together. The bolt catch shaft 6 is attached to the one way needle bearing 12 which rotates only counter clockwise around axle 7. Alternatively, an ordinary bearing may be used. Thus the axle 7 and one way needle bearing 12 together are a means of rotation on which the bolt catch rotates and could be replaced with other means of rotation. If a one way needle bearing is used for bearing 12, the one way needle bearing 12 grabs and rotates the axle 7 when the bolt catch body 2 rotates clockwise. If an ordinary bearing is used for bearing 12, friction will cause axle 7 to try to rotate with the bolt catch shaft 6, giving the same result. When the catch body 2 rotates counter clockwise, however, the axle 7 remains stationary because of one way needle bearing 11, as already explained. A wrap spring 5 (also shown in FIGS. 3B–C) is attached on one end to a ratchet gear 3 via wrap spring node 28 with elongated hole 29, and on the other end to the boss body 13 via wrap spring tail 62 with notch 19. The wrap spring 5 is wrapped around both the catch shaft 6 and the boss shaft 63. Due to surface friction between the wrap spring 5 and catch shaft 6, whenever the bolt catch attempts to rotate counter clockwise in relation to the boss, the wrap spring 5 constricts and securely grabs catch shaft 6 and boss shaft 63. This holds the bolt catch and boss together as one piece. Therefore, the bolt catch stops rotating counter clockwise because the boss (which is attached to axle 7) can not rotate counter clockwise. Ratchet gear 3 is a means of releasing the catch shaft 6 from the wrap spring 5. The ratchet gear 3 is ratchetted so that it grabs the toothed activator belt 8 only when the toothed belt 8 is pulled to the left by the electromechanism in FIGS. 5A, 5B or 5C. When the activator belt 8 is drawn towards the electromechanical device 31 (in FIGS. 5A, 5B, or 5C) the ratchet gear 3 rotates clockwise, unwinding the wrap spring 5 via activator node 28. Thereby the catch shaft 6 is released and the catch body 2 is allowed to rotate counter clockwise, releasing bolt handle 1. The bolt slides forward, firing the gun and then recoils back to the catch body 2. (FIG. 5A shows the bolt handle 1 after being released.) The recoiling bolt handle rotates the catch body 2 clockwise. Due to bearing 12, axle 7 (with the attached boss) also rotates clockwise. (FIG. 5B shows the recoiling bolt handle 1 after the bolt catch body 2 has been rotated clockwise.) The clockwise rotation of the boss and wrap spring 5 causes the gear 3 to rotate clockwise, also. However, the friction of gear 3 rubbing against the toothed belt 8 causes the gear 3 to rotate at a slower rate. Thus, the gear 3 rotates initially counter clockwise in a reference frame in which wrap spring 5 is stationary. However, in the frame of reference of the gun, the gear is rotating clockwise. Therefore, the wrap spring 5 is now free to constrict, again preventing the catch body 2 from rotating counter clockwise, and preventing the bolt handle 1 from being released, as shown in FIG. 5C. Thus the wrap spring 5 and ratchetted gear 3 are a releasable means of preventing the catch body 2, or engagement means, from rotating counter clockwise again.

The purpose of front and back stops 57 and 58 is described later.

E-clip 25 fits into notch 22 on axle 7. The E-clip 25 holds together the bolt catch, ratchetted gear 3, and wrap spring 5 to the boss shaft 63 with boss body 13. The E-clip prevents these parts from sliding apart during operation. Note: The E-clip should hold the assembly together tight enough to operate but just loose enough to allow rotation.

Figure 4:
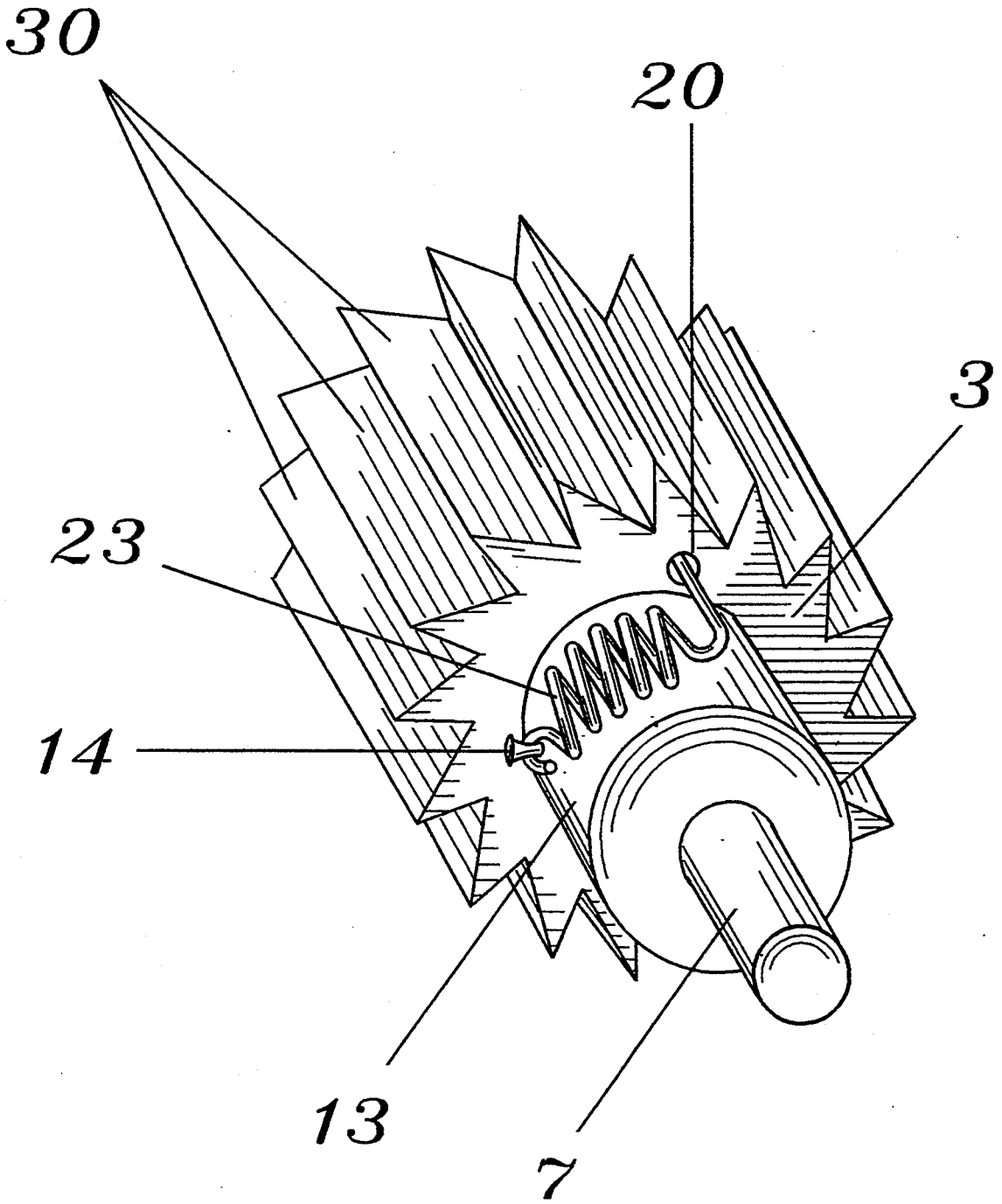
FIG. 4 is an illustration of the attachment of the shock spring.
Figure 6:
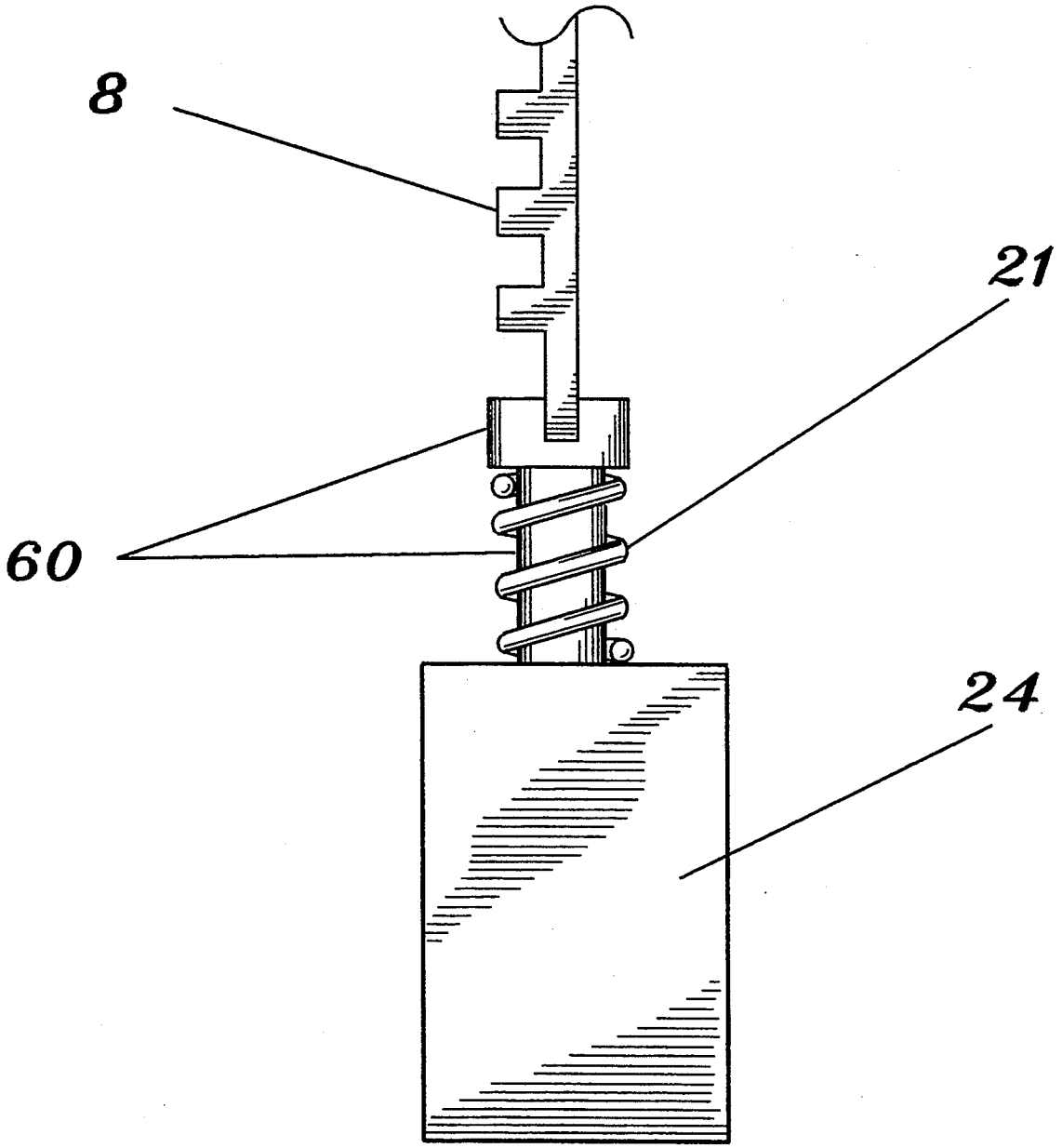
FIG. 6 illustrates one embodiment of the electromechanical device.

FIG. 4 shows one embodiment in which a shock spring 23 is attached to boss body 13 via pin catch 14. Shock spring 23 is also attached to the ratchetted gear 3 via hole 29. The action of the shock spring will be described below. The electro-mechanical device 31 is any means of converting an electrical signal into mechanical motion. For example, it could be any gas driven or mechanical device capable of imparting a pulling force on the toothed belt 8. The preferred embodiment has one solenoid 24 having plunger 60 as shown in FIG. 6. However, more solenoids may be used. At least one solenoid typically has an assist spring 21 which would push the plunger 60 and the belt 8 in the same direction assisting return spring 9. This allows for a more rapid firing by returning the plunger 60 and belt 8 to their starting positions more quickly. The electromechanical device 31 pulls the toothed activator belt 8 to the left in FIG. 5A such that it grabs the teeth 30 of the ratchetted gear 3. When the electromechanical device 31 releases the belt 8, the belt return spring 9 pulls the toothed activator belt 8 to the right, in FIG. 5C, sliding it past the sloped sides of the teeth 30.

Now that the structure of the mechanical assembly of FIGS. 3A–C and 5A–C has been explained, the action of shock spring can be understood.

The shock spring 23 is a means for cushioning or absorbing the shock of the clockwise motion of the catch body 2, that is imparted upon gear 3 when the bolt catch body 2 catches the recoiling gun bolt handle 1. Because of the speed with which the catch body 2 is rotated after it catches the recoiling bolt handle 1, the ratchetted gear 3 is given a large angular momentum. At the end of the bolt handle 1 recoil, the catch body 2 hits backstop 58, and stops rotating clockwise. The axle 7 with the boss and wrap spring 5 attempt to continue rotating clockwise, but the boss rotating clockwise to a stationary catch shaft 6 causes the wrap spring 5 to constrict. This grabs the stationary catch shaft 6 stopping the wrap spring 5, the boss, and the axle 7 from rotating clockwise. Without the shock spring 23, the ratchetted gear 3 would continue to rotate clockwise,. Thus the ratchetted gear 3 would also continue to rotate clockwise with respect to the now stationary axle 7, unwinding the constricted wrap spring 5, and releasing the catch body 2 (cycling). However, shock spring 23 brings the ratchetted gear 3 to a stop so that the wrap spring 5 remains constricted, grabbing the boss shaft 63 and the bolt catch shaft 6, essentially preventing the entire catch body from rotating counter clockwise. An elongated hole 29 in the ratchet gear 3 is used to eliminate any residual clockwise momentum of the rachet gear 3 from being transferred to the wrap spring activator node 28. Other shock absorbing means could replace shock spring 23 of this embodiment.

Figure 5D:
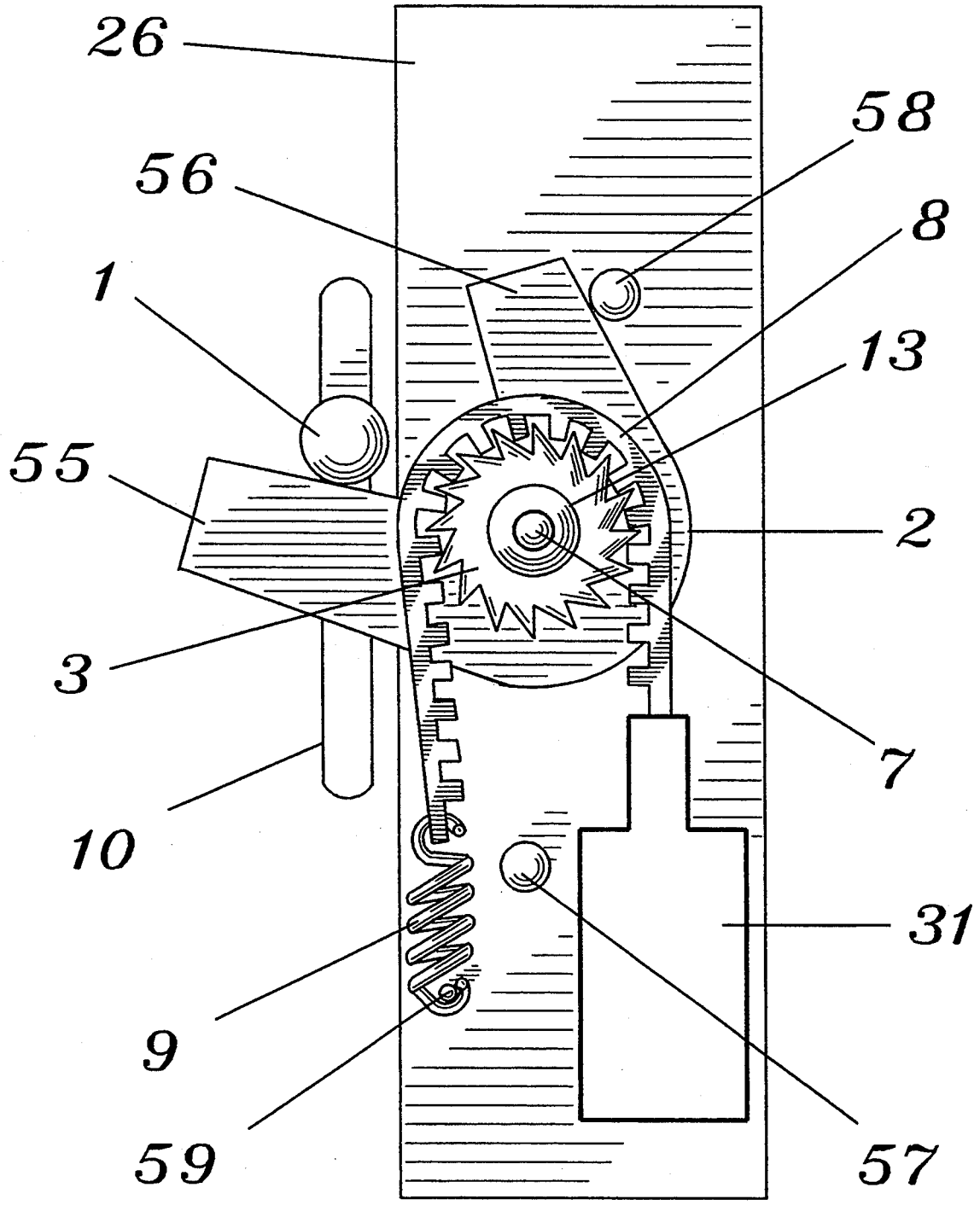

In the embodiment of FIG. 5D the shock spring 23 is obviated by wrapping the toothed belt 8 around the ratchet gear 3 so that it is in contact with gear 3 on about half or more of the circumference of the gear 3. This stops the unwanted clockwise momentum of gear 3. It is important to keep the belt 8 taut at all times. To some extent, the tighter the belt 8 is, the less of the surface of the gear 3 needs to be in contact with the belt 8.

Upon recoiling, the bolt handle 1 will be effectively in a cocked position after being caught by the bolt catch body 2. In the preferred embodiments of the embodiment of FIGS. 5A–5C, or in the preferred embodiment of the embodiment of FIG. 5D, even if the recoil of the bolt handle is so weak that the maximum distance the bolt handle recoil is only about fifty percent of a full distance recoil intended by the manufacturer, the bolt will still have enough recoil to be captured by the bolt catch body 2 thereby preventing cycling. Note: there is not any design limitation inherent in this invention with regards to it controlling the bolt handle 1, for distances of recoil of the gun bolt of significantly less than fifty percent. However, there are not any paint pellet guns for which such a capability would be useful in terms of being able to fire paint pellets. Specifically, most guns can not be loaded with a new paint pellet unless the bolt is cocked in a position of nearly one hundred percent of the distance intended by the manufacturer. For the few paint pellet gun designs where the paint pellets can be placed in the barrel without regard to the percentage of recoil, the present invention will hold the bolt cocked and allow it to be fired just as if the bolt had fully recoiled, as long as the bolt has enough power to fire. Thus the attachment for the gun 18 is capable of catching the bolt handle 1 and retaining it in an effectively cocked position for essentially any usable distance of recoil. Note: a short recoil distance is common when a paint ball gun is low on gas. Catching and retaining the bolt handle at almost any usable distance of recoil makes the likelihood of cycling virtually non-existent in contrast to an unmodified paint ball gun such as the PRO/AM. Additionally, with cycling now prevented, the operator is able to conceal from his opponents that he is low on gas.

As one can see from the earlier descriptions above, the catch body 2 bangs against the bolt handle 1 quite a bit, which is why it is desirable to replace the manufacturer's bolt handle with a heavier bolt handle as already mentioned.

In the interest of full disclosure, the dimensions of many of the components are given below. Although the following device dimensions and parameters can be varied, this information represents a working device and is given as just one example of the present invention. Note: the drawings are not to scale in the interest of keeping the drawings easy to understand. The bolt catch body 2 is roughly a "U" shaped body cut from ⅛" to ¼" thick metal. The angle and position of the front finger 55 inner edge, and the back finger 56 inner edge correspond to the two lines of an imaginary 62 degree angle whose centerpoint is the centerpoint of the axle 7. The pocket 64 edge is perpendicular to an imaginary line which evenly bisects the aforementioned angle. The point of intersection of the edge of pocket 64 and the imaginary line, mentioned above, is inside the 62 degree angle 0.40" distance from the axle 7 centerpoint. The inner edge of front finger 55 is 0.80" long from where it meets the edge of pocket 64. The inner edge of the back finger 56 is 0.40" long from where it meets the edge of pocket 64. At their ends, the front finger 55 and the back finger 56 are both 0.20" wide, and their ends are squared off. The front finger 55 and the back finger 56 both become wider toward the pocket 64, reaching a width of 0.40" each. The remainder of the bolt catch body 2 is roughly semi-circular, forming the outer bottom of the "U"-shape. The radius of this outer bottom curve of the "U" is 0.68" from the axle 7 center point. The diameter of the bolt handle 1 is 0.22" where it contacts the bolt catch body 2. The distance from the bottom of the bolt handle 1 to the axle 7 centerpoint is 0.46". The bolt catch shaft 6 is 0.63" in diameter. The boss shaft 63 is also 0.63" in diameter. The length of the bolt catch shaft 6 is 0.25". The length of the boss shaft 63 is 0.25" The length of the boss body 13 is 0.25" but isn't critical as long as it has enough surface area for the shock spring 23 to rest upon when a shock spring 23 is desired. The diameter of the boss body 13 is 0.79". The wrap spring 5 has a 0.62" inner diameter which gives it a snug fit when it is placed over the 0.63" diameters of the boss shaft 63 and the bolt catch shaft 6. The wrap spring notch 19 is 0.15" long and 0.16" deep. The wrap spring tail 62 is 0.15" in length. The wrap spring activator node 28 is 0.06" in length. The elongated hole 29 is 0.09" in length and 0.06" in width. The elongated hole 29 is 0.03" from the ratchet gears edge. The wrap spring notch's 19 depth makes it's bottom flush with the surface of the boss shaft 63. The wrap spring 5 coil is 0.04" in thickness giving the wrap spring 5 a 0.71" outer diameter when placed over both the boss shaft 63 and the bolt catch shaft 6. The coiled wrap spring 5 is 0.48" in length. The ratchet gear 3 has a 0.73" inner diameter. The ratchet gear's 3 length is 0.47". The outer diameter of the ratchet gear 3 is 1.02", long point to long point. The ratchet gear 3 is punctuated evenly around it's outer diameter by a total of forty teeth. The teeth of the toothed activator belt 8 should be spaced so as to mesh evenly with the ratchet gear 3. The toothed activator belt 8 is typically a durable, flexible nylon and rubber belt, and should be of a narrow width. The preferred width of this belt is 0.20". The belt should be positioned to ride at the center of the ratchet gear's 3 length, parallel with the front frame 27 and rear frame 26, so as not to walk off an edge of the ratchet gear 3 during operation. The axle 7 is 0.31" in diameter and is typically made of a hardened metal to prevent mechanical wear. The one-way needle bearing 11 and the second one-way needle bearing 12 are machined snugly into the front frame 27 and the bolt catch shaft 6, respectively. The shaft sleeve bearing 4 is typically made of brass or a similar soft metal so as not to score the axle during operations. The "E"-clip notch 22 is located such that the "E"-clip 25 can hold the bolt catch shaft 6 to within 0.01" from the boss shaft 63. A wider gap may allow a portion of the wrap spring 5 to become wedged into the gap during constriction. There must always be a slight gap to prevent binding of the bolt catch shaft 6 against the boss shaft 63 during operations. The electromechanical device 31, or in this case, the solenoid 24 must have a pull strong enough to overcome the tension of the wrap spring 5, belt return spring 9, assist spring 21 and, if used, shock spring 23. The solenoid plunger 60 pulls for a distance of 0.25" to guarantee complete release of bolt handle 1. The 0.25" pull of the solenoid plunger 60 must be completed in 0.06" of a second. Also, the belt return spring 9 and the assist spring 21 must return the solenoid plunger 60 and the toothed activator belt 8 to their starting positions within 0.06" of a second in order to achieve the seven to eight shots per second rate of fire. The belt return spring 9 is attached to the toothed activator belt 8 on one end, and is attached to the fastening post 59 on the other end. The fastening post 59 is a narrow shaft which extends from the rear frame 26 to the front frame 27, and is positioned so as not to interfere with the bolt catch body 2 or other portions of this invention. The belt return spring 9 exerts 250 grams of pull on the toothed activator belt 8 in its resting position and 350 grams of pull when it is stretched by the solenoid plunger's 60 pulling action. The assist spring 21 exerts zero grams of push in the resting position and exerts 100 grams of push in the compressed position. If a shock spring 23 is used, it should exert a constant 350 gram counter clockwise force on the ratchet gear 3. The solenoid 24 is pulsed with a forty-eight volt DC pulse, with a 0.06 of a second duty cycle. The solenoid 24 coil resistance is fifty ohms. A more powerful solenoid is necessary if the shock spring 23 is used.

It should be mentioned that since the wrap spring 5 is a friction dependent mechanism, it should never be oiled.

Although the mounting of this invention will vary from one style of gun to the next, the same basic positioning of the invention to the bolt handle 1 should be maintained. The axle 7 of the invention should be below the bolt handle slot 10 at a position that corresponds to typically fifty percent of the travel of bolt handle 1. The bolt handle 1 should protrude from the gun far enough to contact a large portion of the edge of bolt catch body 2, but shouldn't protrude past the bolt catch body 2, thus preventing contact with the ratchet gear 3. The back finger 56 is of a length to block the recoil path of the bolt handle when the bolt handle 1 is in the full forward position, as in FIG. 5A. With the bolt handle 1 fully forward and the back finger 56 in a perpendicular position, the front finger 55 is out of the path of bolt handle 1, is in FIG. 5A. The catch body 2 is kept from rotating too far forward by placement of a front stop 57 in the path of the front finger 55. This ensures that the back finger 56 can never go forward past its desired perpendicular position. The front finger 55 is of sufficient length to prevent it from springing up behind the bolt handle 1 while the bolt handle 1 is in the full forward, or firing position, as in FIG. 5A. The front finger 55 is of sufficient length to block the impending forward movement of bolt handle 1 when the bolt catch body 2 has rotated clockwise, as when the bolt handle 1 has recoiled backwards, in FIG. 5B. The clockwise rotation of the bolt catch body 2 is stopped when the back finger 56 contacts the back stop 58, as in FIG. 5B. The back finger 56 cannot bounce back into the path of bolt handle 1 because this invention stops any residual counter clockwise rotation. The back stop 58 is positioned so that the clockwise rotation of bolt catch body 2 is stopped when the front finger's 55 inner edge is blocking the returning bolt handle's 1 path, at the "optimum" position, as in FIG. 5C. The "optimum" position is 75% of total bolt handle 1 travel, in this case, and typically would match the normal cocked position of an unmodified gun.

The electromechanical device 31 is triggered via a pattern of pulses from a pulse generator. The pulse generator's pattern may be selected by the user. This allows each team to set up codes such that one pattern of shots may send a message of "help I'm in trouble", for example, while simultaneously returning fire. Another example is one team could use the pattern of fire of its teammates as a means of distinguishing friendly fire from enemy fire.

Figure 7:
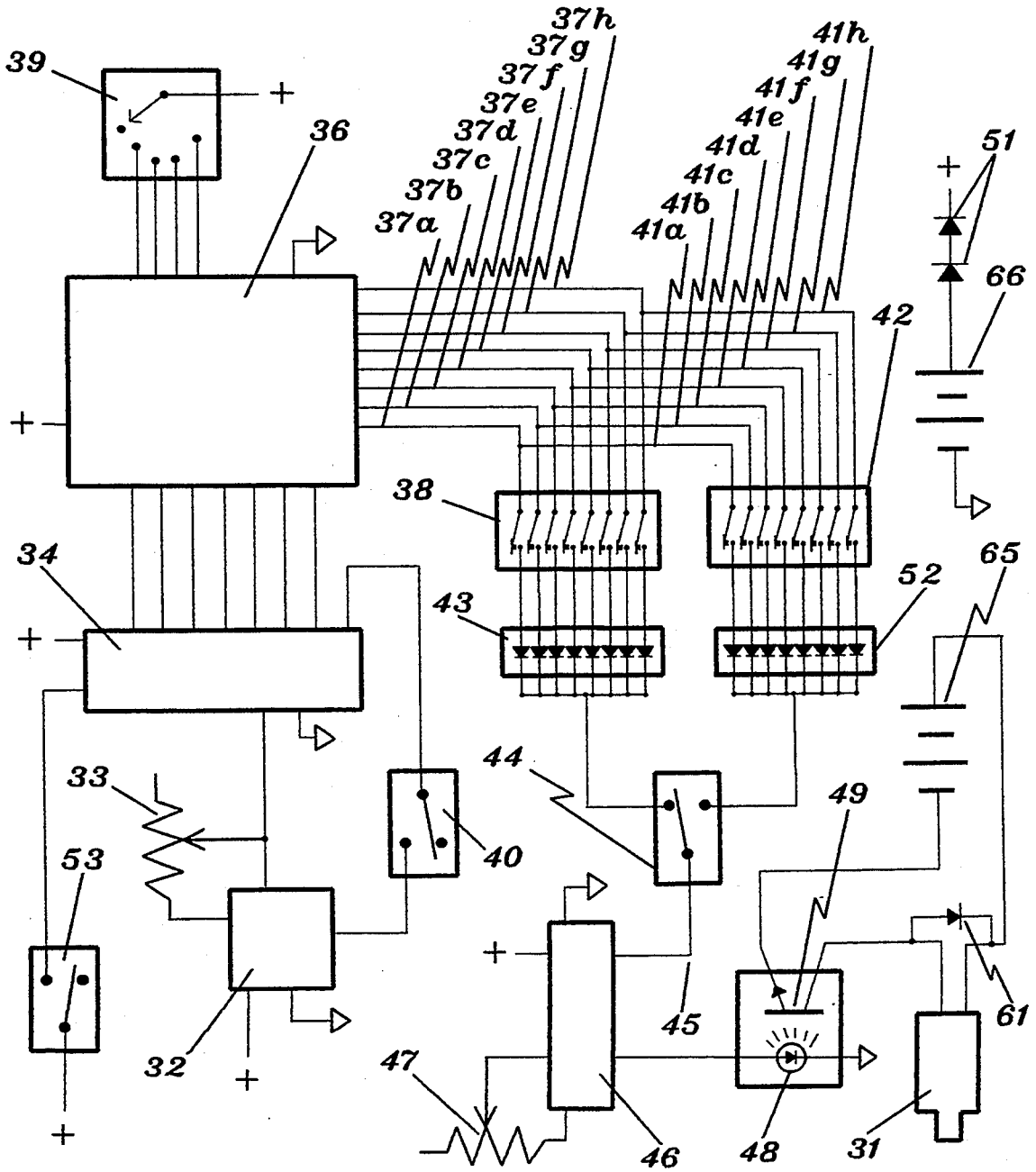
FIG. 7 shows a schematic circuit diagram of the programmable pulse generator.
Figure 8:
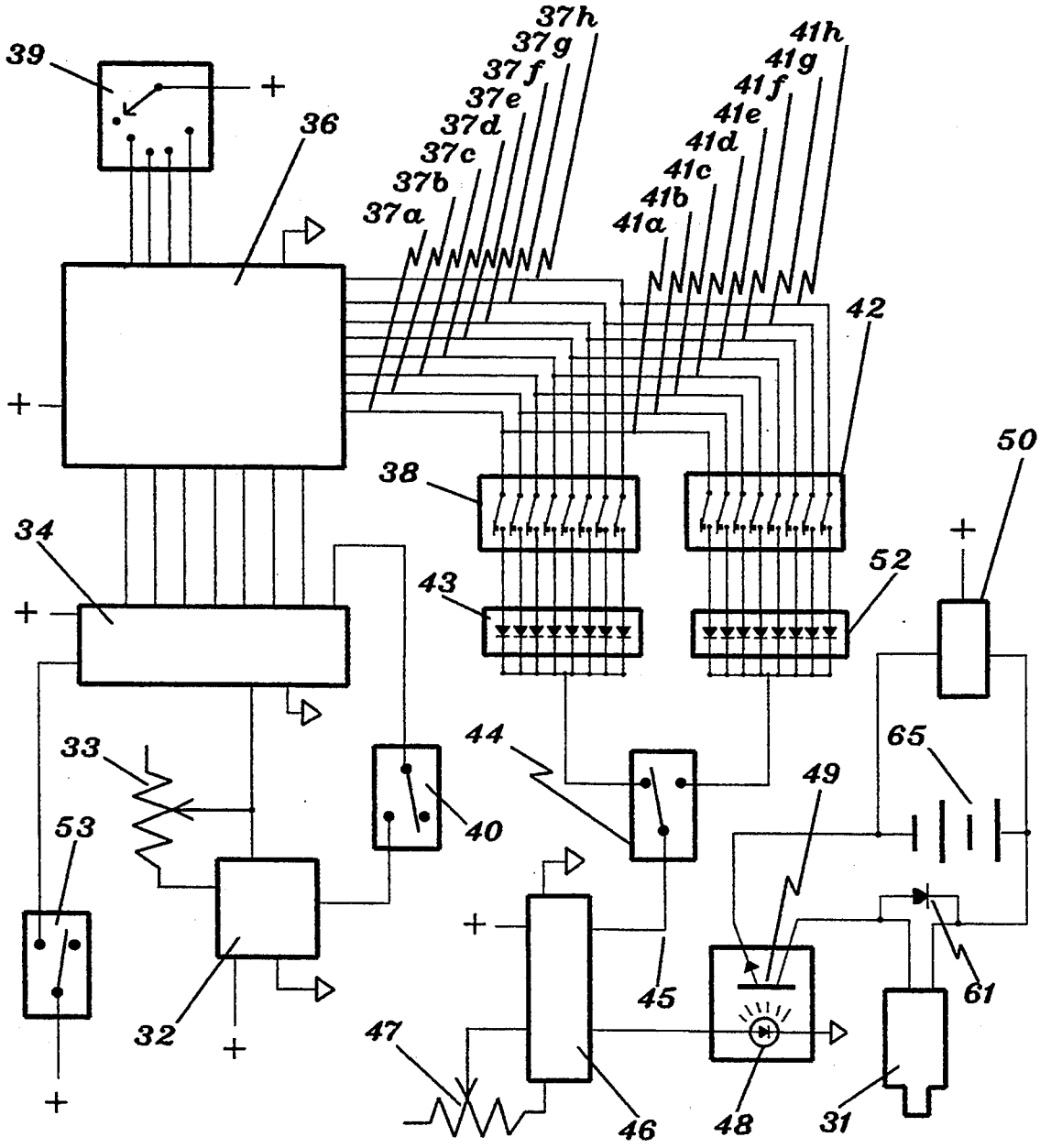
FIG. 8 shows a modification of the circuit in FIG. 7.

The pulse generator is coupled to the trigger 35 via a mechanical switch, optical switch or, pressure sensitive device 53 (FIGS. 7–8).

FIG. 7 shows the workings of the pulse generator.

An oscillator 32 produces a sequence of essentially evenly spaced, essentially identical pulses. Potentiometer 33 is used to regulate the frequency of the pulses. Other means of producing a set of evenly spaced pulses where the period of the pulses is adjustable, other than the potentiometer 33 and oscillator 32 could be used. These pulses are fed into a pulse-to-binary counter 34 which converts the pulse into a set of parallel outputs which are the binary representation of a number. This number is a count of the number of pulses that have been fed into counter 34. The binary output of the counter 34 is fed into the ROM instruction chip 36. Selector switch 39 determines the type of pulse pattern the ROM 36 will output in response to the counter 34 binary input. This is done by putting a logic high voltage on one of the selector switch 39 outputs to the ROM 36. In the preferred embodiment of FIGS. 7–8 the selector switch 39 has one setting which puts no logic high output to the ROM 36. This absence of a selector 39 logic high output causes the ROM 36 to default to the semiautomatic pattern. The other positions of the selector switch 39 correspond to dual burst, tri burst, signature fire, and eight round burst pulse patterns. Larger numbers of possible ROM pulse patterns can be had by modifying the selector switch 39 outputs so that more than one selector 39 output is held high at the same time. In the absence of any logic high from mode selector switch 39, when instruction chip 36 receives the binary pattern that corresponds to count number 1 from the counter 34, a single pulse is sent out of each of the output lines 37 *a–h* of the instruction chip 36 in parallel. As long as at least one of the dip switches in bank 38 is closed, a signal will get through to line 45, triggering solenoid 24 or electromechanical device 31 to pull toothed belt 8, causing the gun to fire. The parallel outputs of ROM chip 36 are redundant. Thus if more than one of switches in bank 38 is closed, although more than one parallel pulse makes its way to line 45 simultaneously, the effect is the same—only one shot is fired. As the counter 34 reaches a count of 128, a stop voltage is sent to the oscillator 32, stopping the oscillator 32 and any further pulse generation. Everytime the trigger 35 is released and pulled the pulse generator will again generate another pulse to fire the gun. The above gives a description of the operation of the pulse generator when it is set to semiautomatic fire, and when switch 40 is in the closed position. When switch 40 is in the open position, the stop voltage never gets to the oscillator, thereby allowing the continous firing of one shot every 128 counts, until the trigger 35 is released. When the pulse generator is set for dual burst via selector switch 39, then for two counts of the counter 34, which are sixteen counts apart (e.g., counts 1 and 17) instruction chip 36 sends out a parallel set of pulses on all of lines 37 *a–h*. Otherwise the operation of the gun is the same as when set to semiautomatic. Similarly for tri burst, the gun sends out a parallel set of pulses on all of lines 37 *a–h* for three counts which are 16 counts apart (i.e., counts 1,17 and 33). Likewise for eight burst, the instruction chip sends out a set of parallel pulses on lines 37 *a–h* for each count 16 counts apart (i.e., 1,17,33 . . . 113) of the counter 34. Full automatic firing can be had by putting switch 40 in the open position while in the eight burst mode, causing a continuous cycling of eight round pulses with an even pause interval between every pulse. This continuous stream of pulses will of course cause continuous firing of the gun until the trigger 35 is released. By adjusting potentiometer 33, one can set the rate of fire so that the rate of fire is slower—much to the relief of the victim. One also benefits in that the slower rate of fires will minimize wasteful usage of paint pellets, cooling of the gun, and splitting of the paint pellets. The optimum rate of fire for fully automatic is about 7–8 shots per second. However, in a tournament faster rates of fire may be desired to ensure hitting the opponent quicker. Of course, one could also have a quadraburst setting or a setting for any number of bursts up to eight or the continuous bursts of fully automatic.

For the signature fire setting, however, a set of sequential pulses are sent on lines 37 *a–h* by instruction chip 36 so that only one pulse is sent down only one of lines 37 *a–h* every sixteen counts of counter 34. For each sixteen counts of counter 34, a pulse is sent down a different one of lines 37 *a–h*. Depending upon which of dip switches in bank 38 are open and which are closed, a different pattern of fire emerges from the gun. For example, the gun could be programmed, using the dip switches, so that pulling and holding down the trigger will cause two shots, a pause for the duration of two shots, and then three more shots and finally a pause. With switch 40 in the open position this sequence would keep on repeating itself as long as the trigger is held down. With switch 40 in the closed position this sequence would occur once and then stop until the trigger is released and squeezed again. At any time releasing the trigger will immediately stop the gun from firing. This is because releasing the trigger 35 closes switch 53 putting a reset voltage to counter 34, and resets the counter 34 to binary zero. The counter 34 is held at zero until the trigger 35 is again pulled, opening switch 53 and releasing counter 34 to begin counting pulses from the oscillator 32. Diode bank 43 stops pulse feedback by not allowing a pulse sent down one line to come back up another line, as the lines are all connected just after diode bank 43. Of course, one could build the pulse generator so as to have the option to choose between any finite number of signature fire settings as one desires without having to change the dip switch settings every time one wants a different signature fire. For each signature fire setting there would be a separate set of lines such as 41 *a–h* having dip switch bank 42 connecting to diode bank 52. A switch 44 selects which diode bank is in the circuit and thereby selects one of the signature fires. Thus the mode selector switch 39, instruction chip 36 and dip switch banks 38 and 42 together are a means of sending several different patterns of signals depending on the instruction given to the chip 36 and on the dip switch settings. No matter which mode of operation is chosen, the signal that is sent to line 45 is too narrow to be usable. Therefore this signal is sent to pulse shaper 46. The width of the pulse put out by pulse shaper 46 is controlled by potentiometer 47. The output pulse of the pulse shaper is fed into an opto-coupler having LED 48 inside which turns on and off a phototransistor 49 inside the opto-coupler, thereby controlling a much larger voltage necessary to activate the electromechanical device 31 (which may be solenoid 24 for example) firing the gun. So the pulse shaper 46, potentiometer 47, LED 48, and phototransistor 49 are a means of controlling a large voltage with the signal from the means of generating several different patterns of signals. The pulse generator itself uses a much smaller voltage than the electromechanical device 31. For example, the electromechanical device 31 may use 12–48 volts D.C. while the pulse generator may use 4–5 volts D.C. One can either have two separate battery supplies—one battery supply 66 for the pulse generator and one battery supply 65 for the electromechanical device 31, as in FIG. 7. Also, one can have one battery supply 65 with voltage regulator 50 to supply the pulse generator as in FIG. 8. Notice in FIG. 8 that because of the single battery supply 65 shared by the pulse generator and the electromechanical device 31, both have their electrical grounds in common. Also notice in FIGS. 7–8 diode 61 provides a safe path for any counter electromagnetic surges of current caused whenever the electromechanical device 31 is deenergized. This diode 61 therefore protects the surrounding circuits from damage.

Diodes 51 of FIG. 7 acts to reduce the voltage across the pulse generator in the event a 6 volt battery is used for battery supply 66. Diodes 51 are diodes in series, each having a voltage drop so that their voltage drops add up to 1–2 volts. The actual number of lines 37, 41 and dip switches in banks 38 and 42 is not crucial.

Although the invention was described as an attachment to a paint pellet gun, it could be used on a real gun. For example, it could be attached to an AK47 as it has a bolt with a bolt handle. For easy reference each feature of the drawings is listed below with its corresponding number:

1. Gun bolt handle
2. Bolt catch body
3. Ratchet gear

4. Activator node
5. Wrap spring
6. Bolt catch shaft
7. Axle
8. Toothed activator belt
9. Belt return spring
10. Bolt handle slot
11. One-way needle bearing
12. Second one-way needle bearing
13. Boss body
14. Pin catch
15. & 16. Screws
17. Housing
18. Prior art gun
19. Notch for wrap spring
20. Hole for shock spring
21. Assist spring on solenoid
22. Notch for E-clip
23. Shock spring
24. Solenoid
25. E-clip
26. Rear frame
27. Front frame
28. Wrap spring activator node
29. Hole for activator
30. Teeth of ratchet gear
31. Electromechanical device
32. Oscillator
33. Potentiometer for oscillator
34. Pulse-to-binary counter
35. Trigger
36. ROM instruction chip
37. *a–h*. Output lines
38. Dip switch bank
39. Mode selector switch
40. Stop/continuous switch
41. *a–h*. Another set of output lines
42. Another dip switch bank
43. Diode bank
44. Switch for choosing a set of output lines
45. Wire to pulse shaper
46. Pulse shaper
47. Potentiometer for pulse shaper
48. LED
49. Phototransistor
50. Voltage regulator
51. Diodes for dropping voltage
52. Another diode bank
53. Trigger switch
54. Trigger housing
55. Front finger of bolt catch body
56. Back finger of bolt catch body
57. Front stop
58. Back stop
59. Fastening post
60. Solenoid plunger
61. Surge protection diode
62. Wrap spring tail
63. Boss shaft
64. Pocket
65. 12 to 48 volt dc battery supply
66. Pulse generator dc battery supply

I claim:

1. An attachment to a gun having a bolt handle wherein at least part of said bolt handle protrudes out of said gun, wherein said bolt handle moves when said gun is fired, comprising:

an electromechanical means for releasing the part of said bolt handle protruding from said gun, allowing said gun to fire and for catching said bolt handle after said bolt handle has at least partly recoiled, preventing said gun from firing, wherein said electromechanical means releases said bolt handle in response to electrical pulses, and a means for generating a predetermined pattern of pulses, wherein said means for generating has a means for producing evenly spaced pulses for said pattern of pulses.

2. An attachment, as described in claim 1, wherein said electromechanical means further comprises:

means for retaining the bolt handle in a position where said gun is essentially cocked, after said bolt handle has recoiled a distance of recoil, wherein said distance of recoil has an end and wherein said distance of recoil is any distance which would cause cycling were the bolt handle not caught and retained and were the end of said distance to be at that position.

3. An attachment for a gun, as claimed in claim 1, wherein said electromechanical means further comprises a mechanical means, said mechanical means having:

an axle having a raised portion, a bearing which rotates in one direction upon which said axle is mounted, an assembly of other parts of said mechanical means rests on said axle.

4. An attachment for a gun, as claimed in claim 1, wherein said electromechanical means further comprises:

at least one solenoid which pulls upon a toothed belt, a mechanical means for releasing and catching said bolt handle wherein said mechanical means releases said bolt handle when pulled upon by said toothed belt.

5. An attachment for a gun, as claimed in claim 1, wherein said electromechanical means further comprises:

a means for engaging said bolt handle, said means for engaging having a portion with a notch for engaging said protrusion, said means for engaging also having a shaft portion wherein the means for engaging is rotatably mounted via said shaft portion.

6. An attachment for a gun, as claimed in claim 1, wherein the electromechanical means further comprises:

a means for engaging said bolt handle, a means for rotating in only one direction, said means for engaging is mounted on said means for rotating in only one direction in a manner that allows said means for engaging to rotate with respect to said means to rotate in only one direction, said one direction with respect to said means to rotate is the opposite direction in which said means to rotate rotates, mechanical means for preventing said means for engaging from rotating with respect to said means for rotating, wherein said mechanical means for preventing is releasable so as to allow said means for engaging to rotate with respect to said means for rotating once said mechanical means is released, and a means for transforming an electrical signal into a mechanical motion which releases said mechanical means for preventing.

7. An attachment for a gun, as claimed in claim 6, wherein said mechanical means for preventing further comprises:

a rachetted gear and a wrap spring having a first end and a second end, said first end is connected to a portion of said means for rotating, said second end is connected to said rachetted gear, said wrap spring wraps around a portion of said means of engaging and constricts to stop said means for engaging from rotating whereby said mechanical motion of said transforming means rotates said rachetted gear thereby loosening said wrap spring, which releases said means for engaging.

8. An attachment for a gun, as claimed in claim 7, wherein said means for transforming further comprises a belt for rotating said ratchetted gear, said belt is taut enough and wraps around said ratchetted gear enough to prevent any cycling caused by the unwinding of the wrap spring.

9. An attachment to as gun, as claimed in claim 1, 2 or 6, wherein said means for generating a predetermined pattern of signals further comprises more than one means for generating a predetermined pattern of signals.

10. An attachment to a gun, as claimed in claim 1, wherein said means for generating a predetermined pattern further comprises:

means for generating a pattern of signals capable of causing the gun to fire a single shot, and means for generating a pattern of signals capable of causing the gun to fire a multiple burst.

11. An attachment to a gun, as claimed in claim 1, wherein said predetermined pattern is a single set of simultaneous pulses during a fixed time frame several times as long as a single pulse.

12. An attachment to a gun, as claimed in claim 1, wherein said predetermined pattern is at least two consecutive sets of simultaneous pulses during a fixed time frame, each of said pulses has a period, said fixed time frame is a time frame several times as long as the period of a single pulse.

13. An attachment to a gun, as claimed in claim 12, wherein the sum total of the periods of said consecutive sets of pulses is equal to the entire time frame.

14. An attachment to a gun, as claimed in claim 1, wherein said pattern of signals is any pattern of sequential pulses, wherein said pulses each have a period, said pattern of pulses has a sum of all the periods, of all the pulses within said pattern, said pattern, of pulses is within a time frame which is longer than said sum of the periods of all the pulses.

15. An attachment to a gun, as claimed in claim 14, further comprising a means wherein a user may change said any pattern to another of said any patterns.

16. An attachment to a gun, as claimed in claim 1, further comprising a switch which has a first setting which causes said pattern to repeat automatically and has a second setting which does not cause the pattern to be repeated.

* * * * *